US011174634B2

(12) United States Patent
Wyman et al.

(10) Patent No.: US 11,174,634 B2
(45) Date of Patent: Nov. 16, 2021

(54) PREFABRICATED CONCRETE FORM WITH STAIRS

(71) Applicant: Framing Systems, Inc., Cleveland, OH (US)

(72) Inventors: Kevin Roger Wyman, Westlake, OH (US); Trevor Frank Wyman, Westlake, OH (US); Roger Alexander Johnston, Bratenahl, OH (US)

(73) Assignee: Framing Systems, Inc., Cleveland, OH (US)

( * ) Notice: Subject to any disclaimer, the term of this patent is extended or adjusted under 35 U.S.C. 154(b) by 2 days.

(21) Appl. No.: 16/932,995

(22) Filed: Jul. 20, 2020

(65) Prior Publication Data

US 2021/0025184 A1 Jan. 28, 2021

Related U.S. Application Data

(60) Provisional application No. 62/877,901, filed on Jul. 24, 2019.

(51) Int. Cl.

| | |
|---|---|
| ***E04B 2/86*** | (2006.01) |
| ***E04F 11/02*** | (2006.01) |
| ***E04G 13/06*** | (2006.01) |
| ***E04G 9/06*** | (2006.01) |

(52) U.S. Cl.

CPC ..... *E04B 2/8635* (2013.01); *E04F 11/02* (2013.01); *E04G 9/06* (2013.01); *E04G 13/06* (2013.01)

(58) Field of Classification Search

CPC ..... E04G 11/14; E04G 11/16; E04G 13/06; E04G 13/062; E04G 2011/0214; E04G 11/022; E04G 11/0223; E04G 11/025; E04B 2/8635; E04F 11/02; E04F 2011/0214; E04F 11/022; E04F 11/0223; E04F 11/025

USPC ..... 52/289, 434, 435, 442, 184, 185, 236.6

See application file for complete search history.

(56) References Cited

U.S. PATENT DOCUMENTS

| | | | | | |
|---|---|---|---|---|---|
| 2,062,724 | A * | 12/1936 | Olsen | E04B 2/8635 | 52/422 |
| 2,434,708 | A * | 1/1948 | Mathis | E04G 11/10 | 249/27 |
| 4,050,203 | A * | 9/1977 | Souza, Jr. | E04F 11/00 | 52/185 |
| 4,532,745 | A * | 8/1985 | Kinard | E04B 2/8629 | 52/251 |

(Continued)

FOREIGN PATENT DOCUMENTS

| | | | | |
|---|---|---|---|---|
| CA | 2348532 A1 * | 5/2000 | E04B 2/8635 | |
| DE | 2033683 A1 * | 1/1972 | E04G 11/16 | |

*Primary Examiner* — Michael Safavi

(74) *Attorney, Agent, or Firm* — Fay Sharpe LLP

(57) ABSTRACT

A prefabricated concrete form with vertical spacers between fill forming cladding with cut-outs in the spacers having horizontal rebar received therethrough and received therein. Stand-offs are provided between the vertical spacers with vertical rebar received on the stand-offs. In one version, the stand-offs are attached to the horizontal rebar. In other versions, the stand-offs are attached to the spacers. A cut-out is formed in one of the claddings to form an auxiliary fill space on the outside of the cladding, which when filled with concrete, upon hardening, forms a ledge for supporting a stair structure.

10 Claims, 7 Drawing Sheets

(56) References Cited

U.S. PATENT DOCUMENTS 4,949,515 A * 8/1990 Krecke ..... E04B 1/163 52/105
5,038,541 A * 8/1991 Gibbar, Jr. ..... E04B 2/8652 52/295
5,887,405 A * 3/1999 Carranza-Aubry ..... E04B 5/04 52/745.1
6,131,358 A * 10/2000 Wise ..... E04B 1/2612 52/289
6,314,697 B1 * 11/2001 Moore, Jr. ..... E04B 2/8635 52/426
6,336,301 B1 * 1/2002 Moore, Jr. ..... E04B 2/8635 52/426
6,647,686 B2 * 11/2003 Dunn ..... E04B 2/8641 52/309.17
6,845,594 B2 * 1/2005 Harber ..... E04B 1/41 52/289
6,935,081 B2 * 8/2005 Dunn ..... E04B 2/8641 249/191
7,437,858 B2 * 10/2008 Pfeiffer ..... E04C 5/02 52/309.11
7,805,908 B2 10/2010 Rutledge
8,051,620 B2 * 11/2011 Kittlitz ..... E04B 1/2612 52/702
10,689,843 B1 * 6/2020 Raccuia ..... E04C 3/08
2005/0016104 A1 * 1/2005 Seccombe ..... E04B 2/8647 52/506.01
2007/0044392 A1 * 3/2007 LeBlang ..... E04B 1/161 52/79.11
2007/0210237 A1 * 9/2007 Stefanutti ..... E04B 1/0007 249/34
2011/0057090 A1 * 3/2011 Spude ..... E04B 2/8652 249/19
2011/0099932 A1 * 5/2011 Saulce ..... E04B 2/845 52/426
2017/0130457 A1 * 5/2017 Naujoks ..... E04C 5/163
2018/0112400 A1 * 4/2018 Dajnko ..... E04B 2/8635

* cited by examiner

PREFABRICATED CONCRETE FORM WITH STAIRS

BACKGROUND

The present disclosure relates to prefabricated forms for hard curable or hardenable fill such as, for example, foam, curable or resinous material, epoxy, and concrete. In particular, the disclosure relates to prefabricated forms for pouring concrete and more specifically for forms for erecting structures such as stairwells and elevator shafts.

In building multi-story towers, it has been found quite labor-intensive and costly to erect on site removable concrete forms for the tower wall sections and particularly costly to remove the forms when the concrete has hardened and then install the stair structure. Thus, it has been desired to find a way or means for providing a cost-effective prefabricated concrete form, which need not be removed, and which includes prefabricated stairs, particularly for multi-story high-rise buildings.

Heretofore, prefabricated forms for pouring sections of walls for multi-story stairs have included structure elements disposed in the fill space, which are attached with fasteners passing through the fill form for supporting the vertical loading of the stair structure prior to filling.

Such prior art prefabricated forms have required on-site hand-wiring of vertical rebar, as shown in FIG. 8, where a form is indicated generally at 1, with fill space boundary cladding 2, 3, spaced by a horizontal truss indicated generally at 4; and, on-site manually positioned rebar 5 hand-wired to the truss. This arrangement has the disadvantage of not only requiring additional structural components within the fill which increases the complexity and cost of the prefabricated form but also the added labor of on-site hand positioning and wiring of rebar.

SUMMARY

The present disclosure describes a unique prefabricated form for pouring hardenable fill material and particularly concrete, where it is desired to have contiguous wall sections forming an enclosed space, such as for multi-story stairwells and elevator shafts. The present prefabricated form has an associated stair structure included; and, the present prefabricated form remains in place upon hardening of the concrete fill. The present form has an auxiliary vertical load-bearing surface or ledge extending outwardly of the form into the enclosed space for supporting the associated stair structure. The ledge vertical load-bearing surface is formed upon pouring concrete fill material into the primary fill space in the form for the wall sections, by concrete flowing through a cut-out to an auxiliary fill space on the outside of the primary fill space for the wall section. The present prefabricated form thus eliminates the need for vertical load-bearing non-fill structure in the primary fill space for the wall section and attachment thereto through the form boundary cladding.

The present form also includes prefabrication of vertical reinforcing bars (rebars) which heretofore have been assembled into the form on site. In the disclosed prefabricated form, stand-offs are provided in the primary fill space for prepositioning the vertical rebar intermediate vertical spacers during fabrication of the forms.

In one version, the stand-offs are secured to prepositioned horizontal rebar passing through the spacers; and in another version, the stand-offs are (i) integrally formed as one piece with the spacers, or (ii) attached to the spacer.

The present disclosure thus describes a complete and cost-effective prefabricated hardenable fill form for an enclosed spaced wall section which may include preplaced stairs. The form with stairs is left in place and need not be removed after pouring of the hardenable fill material.

DETAILED DESCRIPTION

Figure 1:
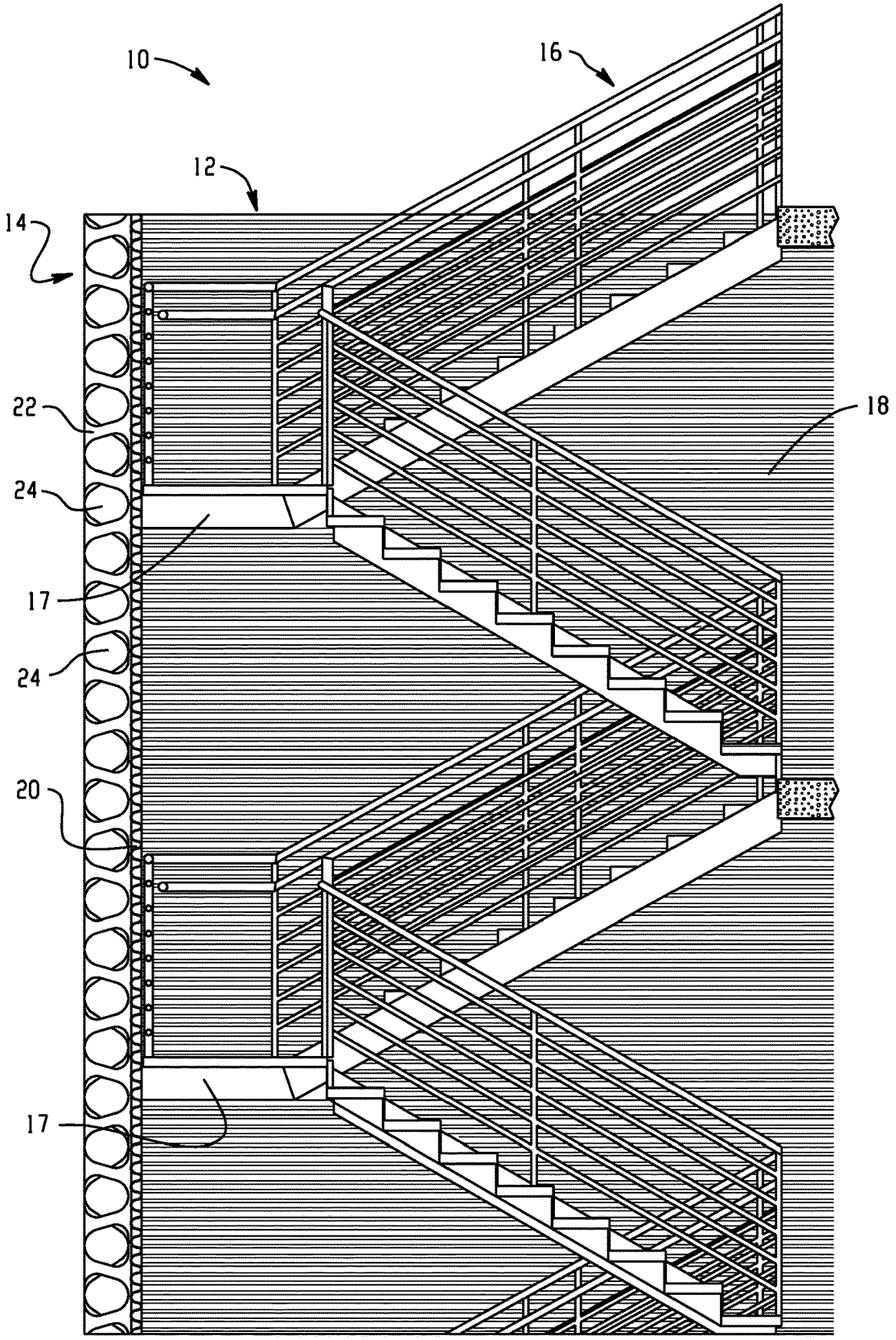
FIG. 1 is a cross-section of a multi-story arrangement of the prefabricated hardenable fill form of the present disclosure including stairwell structure.

Referring to FIG. 1, a completed prefabricated form is indicated generally at 10 as having a plurality of wall sections indicated generally at 12, 14, forming an enclosed space into which is provided prepositioned stair structure indicated generally at 16. In the present practice, the cladding for forming the wall sections may be oppositely disposed horizontally extended corrugated sheet denoted 18, 20 and is separated by vertically extending spacers or ribs 22 having voids or cut-outs 24 formed therein for free flow of fill material, such as poured concrete therethrough. A stair structure, indicated generally at 16 including landings 17, may be prepositioned and supported therewith as will be hereinafter described. In the present practice, the wall sections 12, 14, may extend to a height in the range 8-10 feet (2.4-3.04 meters)

Figure 2:
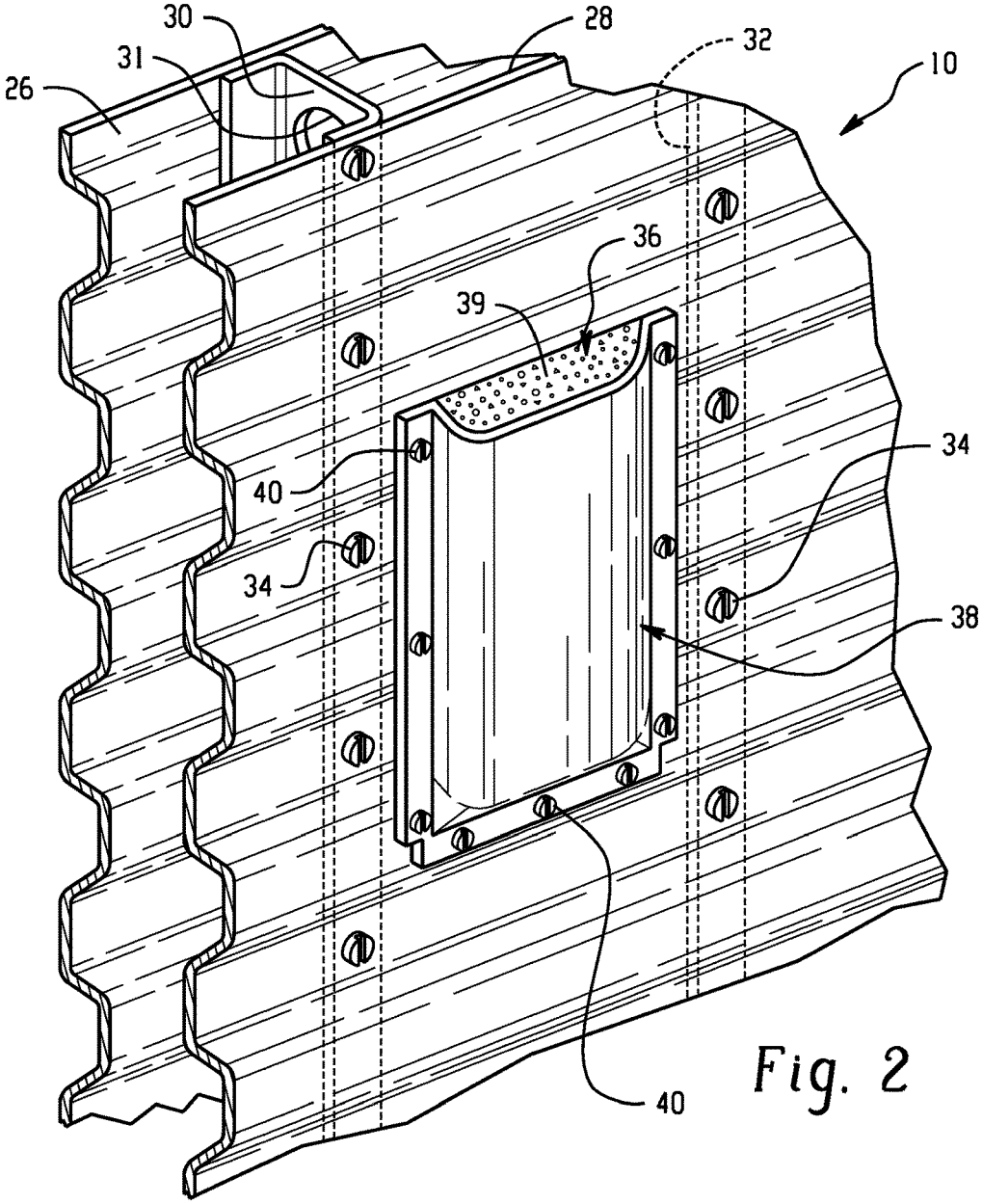
FIG. 2 is a perspective view of a portion of the cladding for the wall forming fill space with the ledge forming fill boundary structure in place.

Referring to FIG. 2, first and second wall cladding 26, 28 for forming the primary load bearing walls of the form 10 are shown in a version which employs horizontally oriented corrugation; however, it will be understood that the cladding may have other configurations, as for example, flat panel configuration. The cladding 26, 28 are separated by a plurality of vertically oriented spacers 30, 32 which have the cladding attached thereto by any suitable expedient, as for example, screws 34. In the present practice, sections of the fill forming cladding 28 are connected and disposed to provide on their exterior a boundary of an enclosed area or space for the stairs 16. In the present practice, the wall sections 12, 14, may extend to a height in the range 8-10 feet (2.4-3.04 meters).

With continuing reference to FIG. 2, a cut-out 36 is formed in the enclosed space-defining cladding 28 so as to communicate with the primary fill forming space between the cladding 26, 28. The cut-out 36 has received thereover a ledge forming or auxiliary fill space-defining cladding member 38 which is open at the upper margin thereof. Upon pouring, hardenable fill material flows through the cut-out 36 and fills the auxiliary space. The fill forming material when hardened, thus forms a ledge 39, which is on the outside of the cladding for the primary fill space between cladding 26, 28. The ledge 39 thus provides a vertical load-bearing surface, upon hardening of the fill material, within the enclosed space for providing additional support supporting auxiliary building structure as, for example, stair structure 16. In the present practice, it has been found satisfactory to locate the cut-outs 36 and auxiliary cladding structure thereover on the primary fill space cladding so as to support, after hardening of the fill material, a stair landing portion 17 (see FIG. 1) to which the stair portions are attached. In the present practice, it has been found satisfactory to attach the auxiliary fill forming space structure 38 to the cladding 28 by fasteners such as screws 40; however, it will be understood that other expedients, such as for example, weldment or adhesives may be employed. Alternately, the auxiliary fill space for forming ledge 39 may be formed integrally with the cladding 28.

Figure 3:
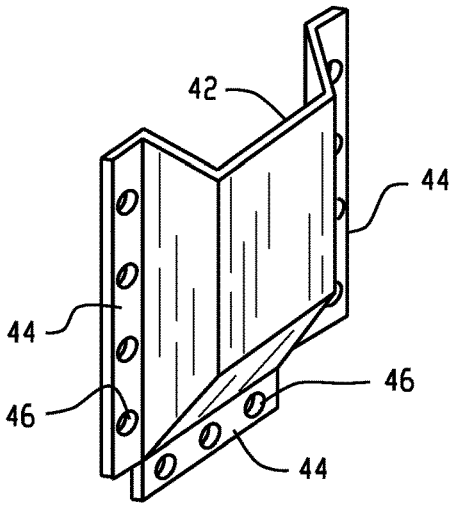
FIG. 3 is a perspective view of another version of the ledge forming fill boundary structure.
Figure 7:
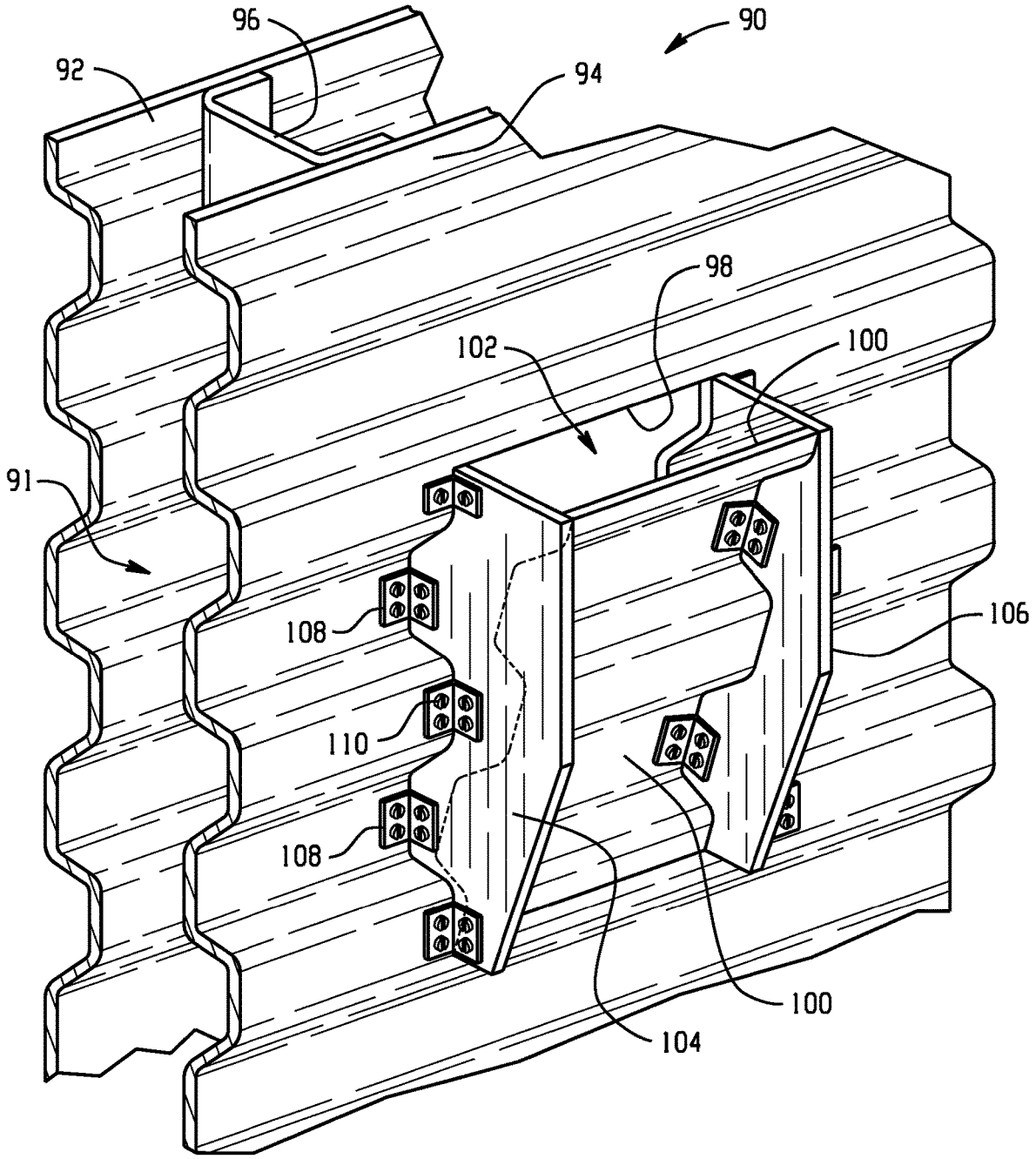
FIG. 7 is a perspective view of a portion of another version of the form of the present disclosure with a cut-out portion of the cladding forming the auxiliary fill space for forming the ledge.
Figure 8:
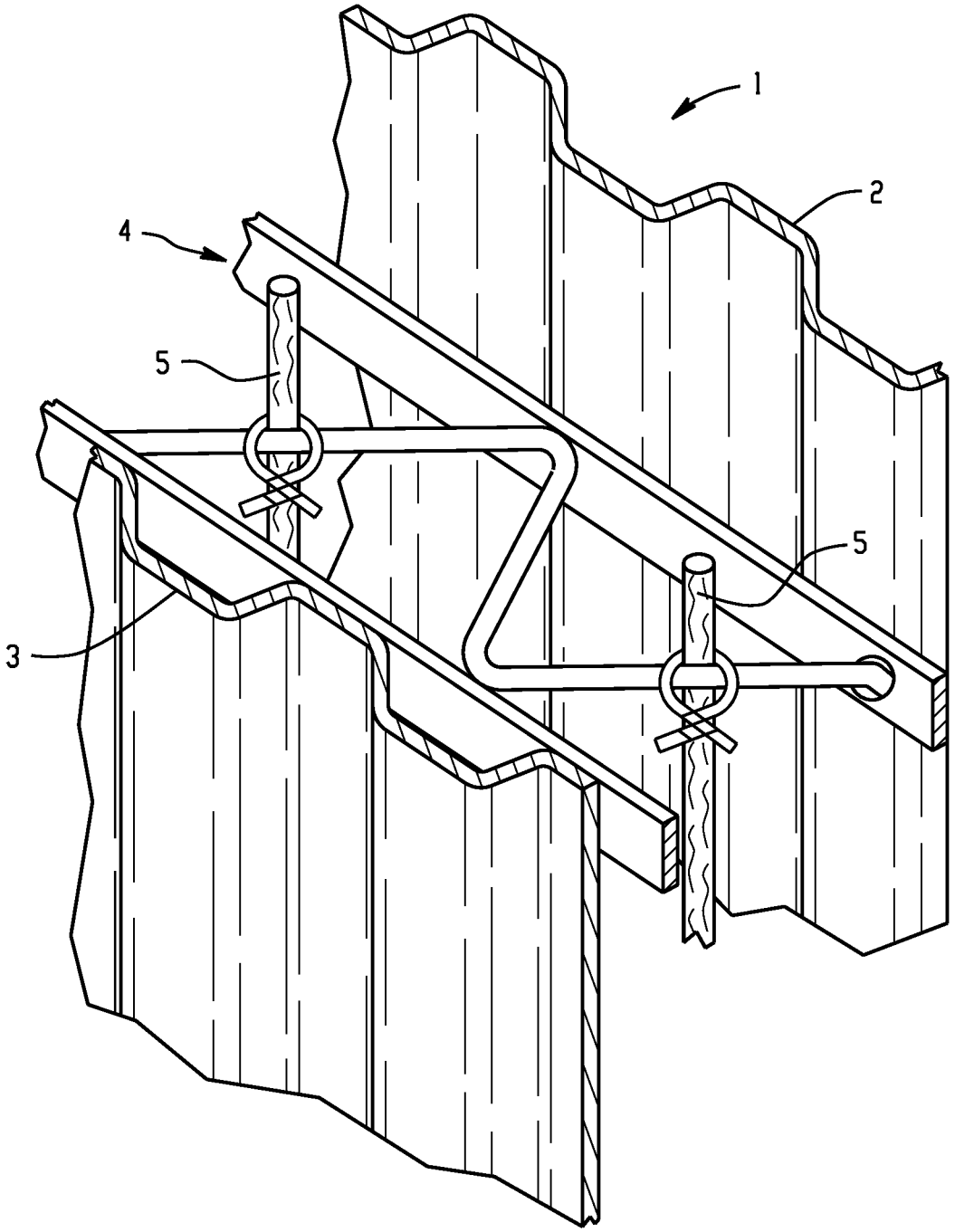
Fig. 8 PRIOR ART
FIG. 8 is a perspective view of a portion of a prior art prefabricated form employing a horizontal truss for spacing primary fill space cladding with manual positioning of the vertical rebar to the truss by on-site hand wiring.

If it is desired to support the stairs in place, prior to introduction of hardenable fill material, with one of the structures of FIG. 3 or 7, it will be understood that the cladding must be designed with sufficient thickness and vertical load bearing strength to support the stairs prior to introduction of hardenable fill material. If lighter and thinner cladding is to be employed, and which is thus unable to support the stairs prior to fill, the stairs must be otherwise supported externally. In the present practice, the version employing corrugated cladding may be formed of 24 gauge sheet metal which has been found satisfactory for maintaining the fill form to the desired configuration under the hydrostatic pressure of the fluid fill material prior to hardening. However, with such relatively thin cladding, the cladding is unable to support the stairs and provisions must be made externally of the form for supporting the stairs prior to introduction of the fill. In the event that it is desired to employ the cladding structure 38 or 100 (see FIG. 7) for supporting the stair structure prior to introduction of hardenable fill into the fill space, it will be understood that the cladding must be designed with substantially heavier material than 24 gauge sheet metal and material having a thickness and strength substantially greater and capable of supporting the stair structure prior to introduction of the hardenable fill material in the fill space. The stair structure may include studs or bars (not shown) extending through the cladding into the fill space for supporting the stairs after hardening of the fill material.

Referring to FIG. 3, an alternate version of the auxiliary fill space forming structure 38 is illustrated at 42 as formed from a single piece of sheet metal with flanges 44 formed around the side and lower periphery thereof with apertures 46 formed therein for receiving fasteners therethrough.

Figure 4:
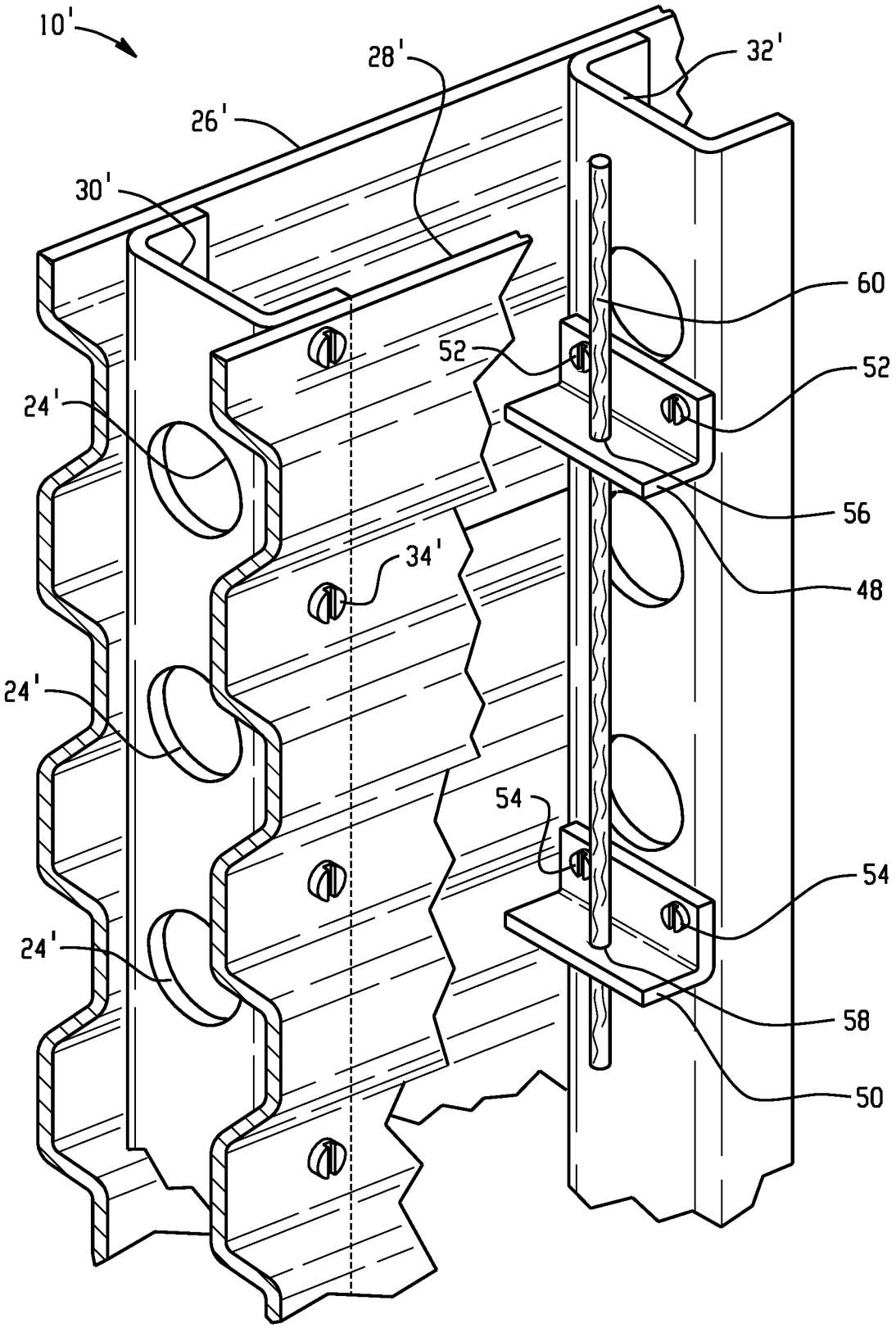
FIG. 4 is a perspective view of a portion of the cladding for the primary wall fill space showing the spacers with stand-offs with a vertical rebar in position thereon.

Referring to FIG. 4, an alternate arrangement or version of the prefabricated form is shown at 10' wherein the corresponding parts thereof have like reference numerals with primes. The spacer 32' is shown as having a plurality of stand-offs 48, 50 spaced vertically thereon and which are attached to the spacer by any suitable expedient such as, for example, screws 52, 54, respectively. Each of the stand-offs 48, 50 has an aperture respectively 56, 58 formed therein which apertures are vertically aligned and have received therethrough a reinforcing bar 60, or rebar as commonly referred to, which is maintained and positioned in the illustrated vertically oriented arrangement. It will be understood that other spacers such as the spacer 30' may also have stand-offs and a vertical reinforcing bar provided thereon, but which have been omitted from FIG. 3 for simplicity of illustration.

Figure 5:
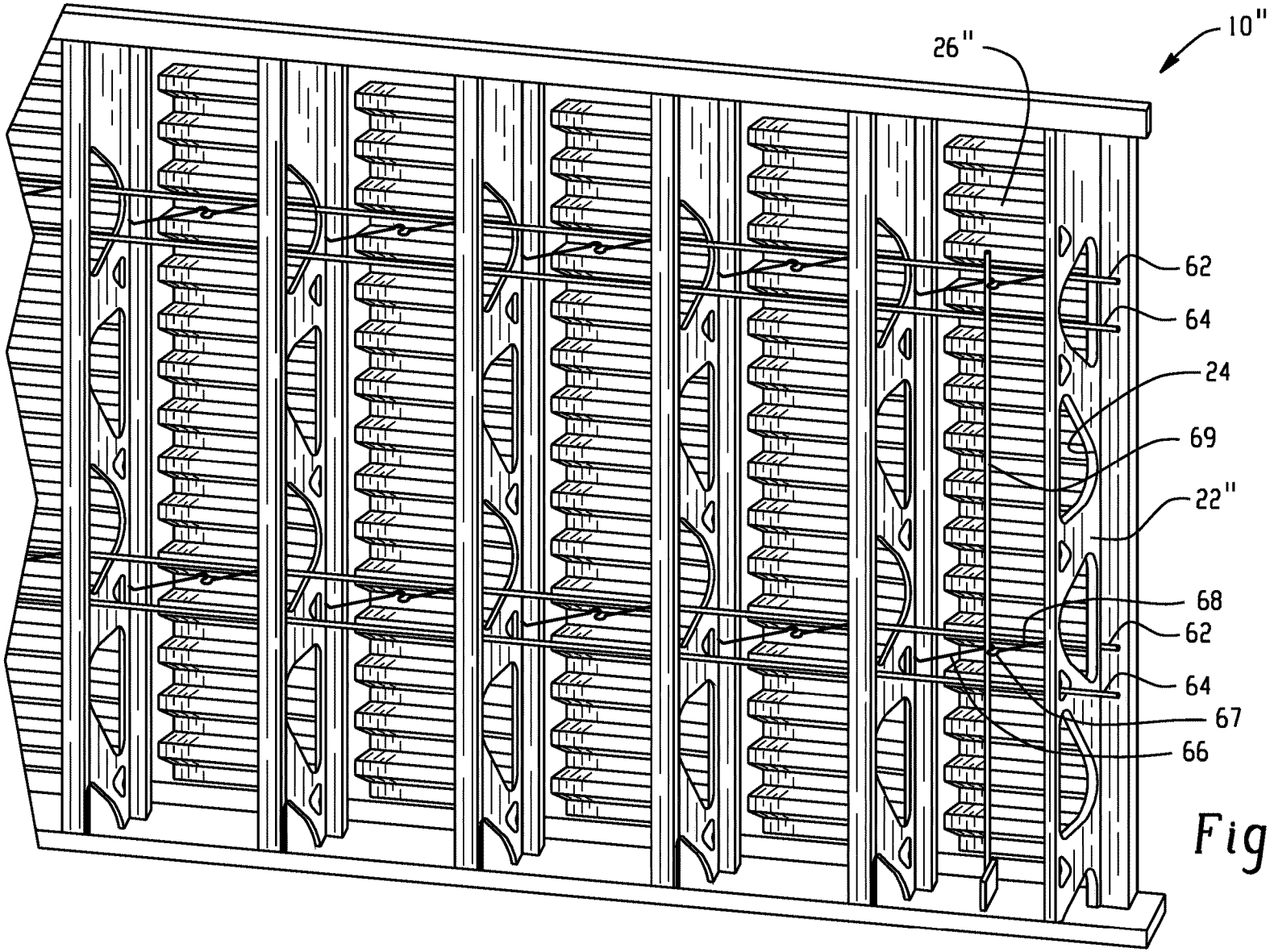
FIG. 5 is a perspective view of a portion of the primary fill space with one side of the cladding removed showing the spacers with another version of stand-offs for positioning vertical rebar and horizontal rebar through the cut-outs.

Referring to FIG. 5, another version of the prefabricated fill form of the present disclosure has a portion of the primary fill space forming structure indicated generally at 10", has cladding 26" illustrated with spacers 22" with voids or cut-outs 24". In the version of FIG. 5, pairs of horizontally extending reinforcing bars or rebars, as denoted by reference numerals 62, 64 are received through cut-outs or voids 24" and suitably secured therein, as by wiring. The horizontal rebars 62, 64 may have attached thereto and extending therebetween, stand-offs 66, 68 having locating surfaces thereon, for example, open loops 67 as shown in FIG. 5 receiving therein a vertically oriented reinforcing bar 69. Alternatively, stand-offs 66, 68 may be attached to the spacers.

Figure 6:
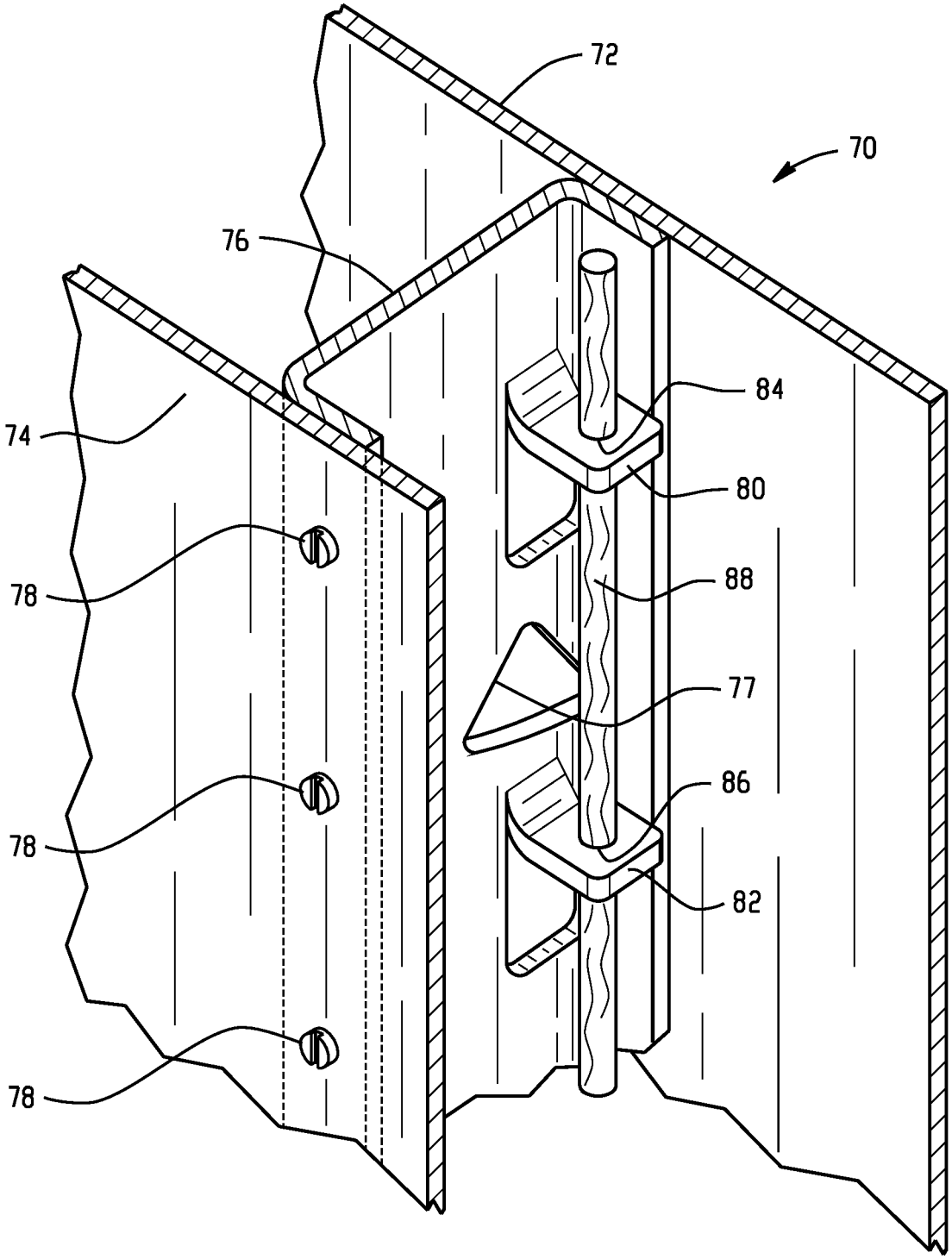
FIG. 6 is a perspective view of a portion of the cladding employing flat panels with stand-offs integrally formed on spacers for positioning a vertical rebar.

Referring to FIG. 6, another version of the wall section defining a primary fill space is indicted generally at 70 and has spaced cladding members shown as flat panels 72, 74 with vertically oriented spacers such as spacer 76 with cut-outs one of which is shown at 77 for fill passage therebetween and which have the spaced cladding panels 72, 74 attached thereto by suitable fasteners 78. Although the cladding 72, 74 is illustrated in FIG. 6 in flat panel form, it will be understood that the cladding may also have a corrugated form similar to that shown in the version of FIG. 2. A plurality of vertically-spaced stand-offs 82, 84 are integrally formed, such as by piercing, on the spacer 76 and have vertically aligned apertures or cut-outs 84, 86, respectively, formed therein through which a vertical rebar 88 is received.

Referring to FIG. 7, another version of the presently disclosed prefabricated concrete fill form for a wall section is shown generally at 90 with the primary fill space indicated generally at 91 formed between oppositely disposed claddings 92, 94 which are attached to vertical spacers such as spacer 96. A cut-out 98 is formed in one of the claddings 94 with a portion 100 of the cladding 94 remaining connected and moved outwardly from the cut-out 98 to form an auxiliary fill space indicated generally at 102.

The sides of the auxiliary fill space 102 are formed by side plates 104, 106 secured to the cladding by brackets, indicated typically at 108, which may be secured to cladding 94 by any suitable expedient such as weldment or fasteners indicated typically at 110.

Upon pouring of concrete in the primary fill space 91, concrete flows into auxiliary fill space 102 for forming at its upper surface a ledge for supporting stairs after hardening of the fill material (not shown). If desired, the cut-out for forming the ledge may extend for the width of a stair landing for supporting the stairs attached thereto. The side plates may also be secured to the cladding portion with brackets (not shown) are weldment. As with the version of FIG. 2, if the stairs is to be supported by the form 90, prior to introduction of hardenable fill material, the cladding 94 must be formed of material having sufficient thickness and strength to support a stair structure. If thinner or lighter cladding, such as 24 gauge metal, is to be employed, the stairs must be otherwise externally supported prior to introduction of hardenable fill material.

The exemplary embodiments have been described and illustrated with reference to the drawings. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. In a prefabricated form for hardenable fill material, the improvement comprising:

(a) a wall section having a first layer of cladding and a second layer of cladding disposed therewith in spaced arrangement and defining a fill space therebetween for receiving the fill material poured into the fill space;

(b) a plurality of spaced vertically oriented ribs/spacers disposed intermediate the first and second layer of cladding and operatively secured thereto and supporting same thereon;

(c) a plurality of spaced cut-outs formed in each of the ribs/spacers operative to permit flow of the fill material therethrough, wherein one of the cut-outs in each of the plurality of ribs/spacers is aligned with one of the cut-outs in each of the remaining ribs/spacers;

(d) at least one first reinforcing bar received through each of the aligned cut-outs, wherein the at least one reinforcing bar is positioned therein and maintained in a predetermined desired position;

(e) a plurality of stand-offs disposed intermediate the ribs/spacers in vertically spaced arrangement, wherein each of the stand-offs has certain surfaces thereon aligned with the corresponding certain surfaces in each of the remaining stand-offs; and, (f) a second reinforcing bar received through the aligned certain surfaces in the stand-offs, wherein the certain surfaces in the stand-offs are operative to maintain the second reinforcing bar in a vertically oriented position;

wherein each of the plurality of ribs is formed of sheet metal.

2. The improvement of claim 1, wherein the stand-offs are formed integrally attached to the respective rib/spacer.

3. The improvement of claim 1, wherein each of the plurality of stand-offs are attached respectively to adjacent ones of the ribs/spacers.

4. The improvement of claim 1, wherein the stand-offs are each attached respectively to a pair of the first reinforcing bars.

5. The improvement of claim 1, wherein the first and second layers of cladding are disposed in vertically oriented arrangement.

6. The improvement of claim 1, wherein the wall section extends vertically to a height in the range 8-10 feet (2.4-3.04 meters).

7. In a prefabricated form for hardenable fill material, the improvement comprising:

(a) a wall section having a first layer of cladding and a second layer of cladding disposed therewith in spaced arrangement and defining a fill space therebetween for receiving the fill material poured into the fill space;

(b) a plurality of spaced vertically oriented ribs/spacers disposed intermediate the first and second layer of cladding and operatively secured thereto and supporting same thereon;

(c) a plurality of spaced cut-outs formed in each of the ribs/spacers operative to permit flow of the fill material therethrough, wherein one of the cut-outs in each of the plurality of ribs/spacers is aligned with one of the cut-outs in each of the remaining ribs/spacers;

(d) at least one first reinforcing bar received through each of the aligned cut-outs, wherein the at least one reinforcing bar is positioned therein and maintained in a predetermined desired position;

(e) a plurality of stand-offs disposed intermediate the ribs/spacers in vertically spaced arrangement, wherein each of the stand-offs has certain surfaces thereon aligned with the corresponding certain surfaces in each of the remaining stand-offs; and, (f) a second reinforcing bar received through the aligned certain surfaces in the stand-offs, wherein the certain surfaces in the stand-offs are operative to maintain the second reinforcing bar in a vertically oriented position;

wherein the first and second layers of cladding are formed of corrugated sheet metal.

8. In a prefabricated form for hardenable fill material, the improvement comprising:

(a) a wall section having a first layer of cladding and a second layer of cladding disposed therewith in spaced arrangement and defining a fill space therebetween for receiving the fill material poured into the fill space;

(b) a plurality of spaced vertically oriented ribs/spacers disposed intermediate the first and second layer of cladding and operatively secured thereto and supporting same thereon;

(c) a plurality of spaced cut-outs formed in each of the ribs/spacers operative to permit flow of the fill material therethrough, wherein one of the cut-outs in each of the plurality of ribs/spacers is aligned with one of the cut-outs in each of the remaining ribs/spacers;

(d) at least one first reinforcing bar received through each of the aligned cut-outs, wherein the at least one reinforcing bar is positioned therein and maintained in a predetermined desired position;

(e) a plurality of stand-offs disposed intermediate the ribs/spacers in vertically spaced arrangement, wherein each of the stand-offs has certain surfaces thereon aligned with the corresponding certain surfaces in each of the remaining stand-offs; and, (f) a second reinforcing bar received through the aligned certain surfaces in the stand-offs, wherein the certain surfaces in the stand-offs are operative to maintain the second reinforcing bar in a vertically oriented position;

wherein the first and second layers of cladding are formed of 24 gauge thickness sheet metal.

9. A prefabricated form for hardenable fill material comprising:

(a) a first and second fill forming boundary member disposed in spaced relationship and defining a primary fill space therebetween;

(b) a cut-out formed in one of the first and second boundary members operative to permit fill material to flow therethough; and (c) an auxiliary fill forming boundary member disposed over the cut-out outside said primary fill space and configured to form an auxiliary fill space, wherein upon pouring of fill material in the primary fill space, the auxiliary fill space is filled and upon hardening of the fill material, an auxiliary vertical load bearing surface is formed in the auxiliary fill space;

(d) a plurality of distinct sections of one of the first and second fill forming boundary members disposed to form the auxiliary fill space with the auxiliary vertical load-bearing surface formed on each of the plurality of distinct sections; and, (e) an associated structure disposed on the auxiliary vertical load-bearing surface;

wherein the associated structure comprises a stair structure.

10. A method of making a prefabricated hardenable fill material form comprising:

(a) disposing first and second layers of fill forming material in spaced relationship and forming a primary fill space therebetween;

(b) forming a cut-out in one of the first and second layers of fill forming material;

(c) disposing fill forming material over the cut-out and forming an auxiliary fill space in communication with outside the primary fill space;

(d) pouring fill material in the primary fill space thereby flowing fill material into the auxiliary fill space and forming an auxiliary vertical load-bearing surface upon hardening of the fill material; and (e) supporting associated building structure on the auxiliary vertical load-bearing surface;

wherein supporting associated building structure includes supporting stair structure.

* * * * *